US006364248B1

(12) United States Patent
Spate et al.

(10) Patent No.: US 6,364,248 B1
(45) Date of Patent: Apr. 2, 2002

(54) ARTICULATED NOSE MISSILE CONTROL ACTUATION SYSTEM

(75) Inventors: Wayne V. Spate; Robert J. Adams; Donald P. Williams, all of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/610,924

(22) Filed: Jul. 6, 2000

(51) Int. Cl.[7] ..... F42B 10/26
(52) U.S. Cl. ..... 244/3.23; 266/3.21
(58) Field of Search ..... 244/3.23, 3.21, 244/3.1, 75 R; 114/23; 102/384

(56) References Cited

U.S. PATENT DOCUMENTS 3,069,112 A * 12/1962 Patterson
4,399,962 A 8/1983 Wedertz et al.
4,426,048 A * 1/1984 Mildren
4,579,298 A * 4/1986 Thomson
4,793,571 A * 12/1988 Kranz
4,925,130 A 5/1990 Kranz
4,998,994 A 3/1991 Schmidt et al.
5,083,724 A * 1/1992 Kranz
5,139,216 A * 8/1992 Larkin
5,564,651 A * 10/1996 Wiemer et al.

* cited by examiner

*Primary Examiner*—Peter M. Poon
*Assistant Examiner*—T. Dinh
(74) *Attorney, Agent, or Firm*—Renner, Otto, Boisselle & Sklar, LLP

(57) ABSTRACT

A missile nose is tiltable and rotatable relative to a missile body through the action of an actuator system. In an exemplary embodiment, the actuator systems uses two electromechanical actuators mounted co-axially and having the output shaft of one actuator fed through the shaft of the other. One of the actuators controls a tilt angle between a longitudinal axis of the body and a longitudinal axis of the nose. The other actuator rotates the nose about the longitudinal axis of the body. A method of steering a missile includes using the actuator system to maintain the missile nose pointed at a target or other desired destination.

31 Claims, 2 Drawing Sheets

ARTICULATED NOSE MISSILE CONTROL ACTUATION SYSTEM

BACKGROUND OF THE INVENTION

1. Technical Field of the Invention

The invention relates to directional control systems and methods for missiles.

2. Description of the Related Art

Steering control of missiles may be achieved by deflecting a set of control surfaces attached to the rear of the missile body, each control surface having its own respective control actuator to provide the necessary deflection torque. However, a class of missiles and projectiles exists for which this approach is inadequate, due to the relatively large volume and increased package size for separate deflectable control surfaces. In the past, canards, jet plume diverters, and articulated nose controls have been used as alternatives to rear-body control surface steering. However, canards may have the disadvantage of requiring unacceptable amounts of external volume, thereby creating difficulties for missile storage and/or launch. In some such cases, the canards may be designed as folding or "pop-out" control surfaces; however, this often adds significant complexity, cost, and missile volume.

Jet divert mechanisms may have the disadvantages of being able to provide only a discrete nature of control, of inducing increased drag, and/or of inducing oscillations in the missile.

In many applications, nose control may provide significant advantages over either rear steering, canard, or jet divert designs. The articulated nose may provide steering with minimal effect on the external missile/projectile packaging, minimum drag characteristics, and smooth, continuous steering. It is understood that a simple steering mechanism can be achieved by always pointing the nose toward the target, therefore allowing resulting aerodynamic forces to fly the missile toward the target.

Prior actuation implementation systems to effect nose deflection or articulation have generally utilized pyrotechnic, piezo-electric, or electro-magnetic actuators. An exemplary prior art pyrotechnic nose cone actuation system contains two banks of pyrotechnic actuating cylinders, each of the cylinders attached to an individual ignitor. Actuation is achieved by firing the cylinders to extend and lock a corresponding piston, thereby causing angular deflection of a pivot-mounted nose cone. Pyrotechnic systems have the disadvantage of being discrete by nature, since they typically require the firing of a piston to full stroke. Therefore, changes in the nose cone deflection are discrete and sudden. Small trajectory errors are therefore more difficult to correct and accuracy is correspondingly diminished.

An exemplary piezo-electric actuated nose cone contains a pair of piezo-actuators for each desired axis of nose deflection or articulation. Such piezo-actuators are relatively fragile and are typically limited to providing small displacements. Therefore, such actuation systems are typically restricted to applications where small nose deflections are acceptable.

It will be appreciated from the foregoing that improved mechanisms and methods for steering a missile are needed.

SUMMARY OF THE INVENTION

A missile nose is tiltable and rotatable relative to a missile body through the action of an actuator system. In an exemplary embodiment, the actuator system uses two electromechanical actuators mounted co-axially and having the output shaft of one actuator fed through the shaft of the other. One of the actuators controls a tilt angle between a longitudinal axis of the body and a longitudinal axis of the nose. The other actuator rotates the nose about the longitudinal axis of the body. A method of steering a missile includes using the actuator system to maintain the missile nose pointed at a target or other desired destination.

According to an aspect of the invention, a missile includes a pair of rotary actuation devices for positioning a missile nose relative to a missile body.

According to another aspect of the invention, a missile includes a pair of actuators for positioning a missile nose relative to a missile body, at least part of one of the actuators being co-axial with at least part of the other actuator.

According to yet another aspect of the invention, a missile includes a pair of actuators for positioning a missile nose relative to a missile body, at least part of one of the actuators nested in at least part of the other actuator.

According to still another aspect of the invention, a missile includes a tilt actuator for tilting a nose of the missile relative to a body of the missile, the tilt actuator including a rotary actuation device operatively coupled to a translatable member.

According to a further aspect of the invention, a missile includes an actuator system for articulating a nose of the missile relative to a body of the missile, at least part of the actuator system being located in a nose cavity of the nose.

According to a still further aspect of the invention, a missile includes an a pair of actuators for articulating a nose of the missile relative to a body of the missile, at least part of each of the actuators being located in a nose cavity of the nose.

According to another aspect of the invention, a missile includes a missile nose having a longitudinal nose axis; and a missile body having a longitudinal body axis, the body including an actuator system hingedly coupled to the nose at a central connection on the nose which is at an intersection between the longitudinal nose axis and the longitudinal body axis. The actuator system is operationally configured to rotate the nose about the longitudinal body axis relative to the body.

According to yet another aspect of the invention, a missile includes means for tilting a missile nose relative to a missile body in a fixed plane relative to the body, and means for rolling or spinning the missile.

According to still another aspect of the invention, a missile includes a missile nose and a missile body which includes a tilt actuator with a translatable member mechanically linked to an offset connection point on the nose. The offset connection point is offset from a longitudinal body axis.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages, and novel features of the invention will become apparent from the following detailed description of the invention when considered in conjunction with the drawings.

DETAILED DESCRIPTION

Figure 1:
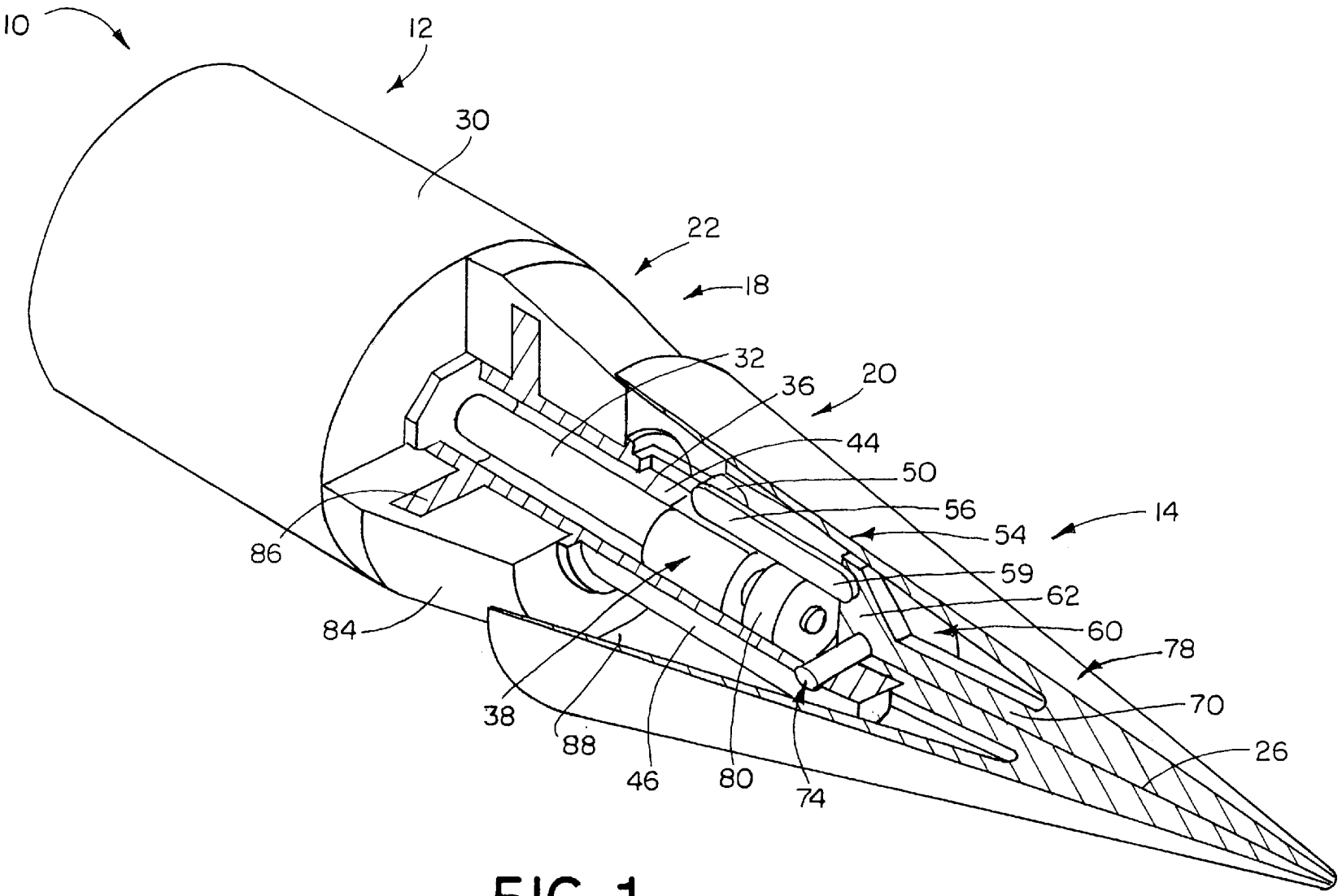
FIG. 1 is a partial-section perspective view of a missile embodying the present invention.
Figure 2:
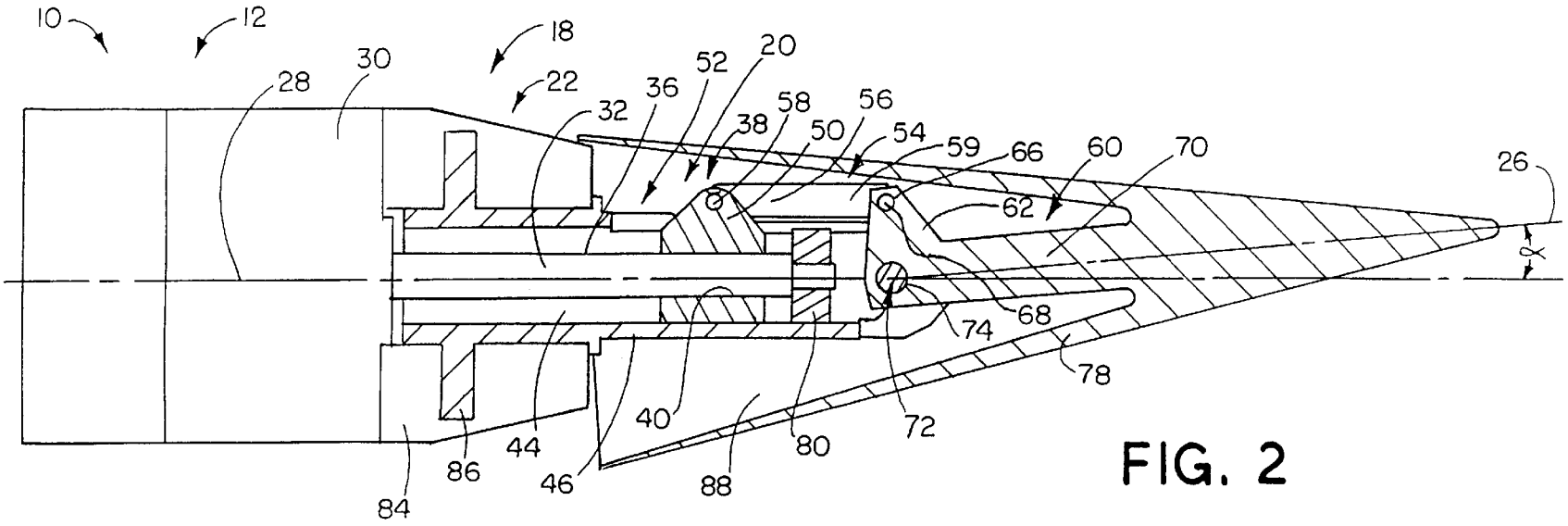
FIG. 2 is a side sectional view of the missile of FIG. 1.

Referring to FIGS. 1 and 2, a missile 10 has a missile body 12 and a missile nose 14. The body 12 includes an actuator system 18 for articulating the nose 14 relative to the body. As described in greater detail below, the actuator system 18 includes a pair of actuators co-axial with one another, at least part of one of the actuators being nested within at least part of the other actuator. The actuator system 18 includes a tilt or deflection actuator 20 and a rotation actuator 22.

The tilt actuator 20 operates to control an angle of deflection a between a nose longitudinal axis 26 of the nose 14 and a body longitudinal axis 28 of the body 12. The rotation actuator 22 is operable to rotate the nose 14 relative to the body 12. For example, the rotation actuator 22 may control rotation of the nose 14 about the longitudinal body axis 28.

The tilt actuator 20 includes a rotary actuation device such as a motor 30. The motor 30 or a shaft of the motor is coupled to rotate a lead screw 32 having a threaded exterior surface 36. A translatable member such as a lead nut 38 is operatively coupled to the lead screw 32, the lead nut 38 having a threaded interior surface 40. Rotation of the lead screw 32 therefore results in translation of the lead nut 38 along the lead screw 32. The lead screw 32 and the lead nut 38 are for the most part located in a central cavity such as a central bore 44 of a hinge mount shaft 46. However, a protruding portion 50 of the lead nut 38 protrudes through a slot 52 in the hinge mount shaft 46. A nut-nose link 54 is hingedly coupled, at a first end 56, to the protruding portion 50 at a hinged nut connection 58. The link 54 is hingedly connected at its opposite end 59 to an L-shaped member 60 of the nose 14. The hinged coupling between the nut-nose link 54 and a short arm 62 of the L-shaped member 60 occurs via a hinged nose connection 66 at an offset connection point 68 on the L-shaped member which is offset from the longitudinal body axis 28. The hinged connections 58 and 66 may include suitable well-known connecting devices, for example, rivets, nut-and-bolt connections, or pins.

At the junction of the short arm 62 and a long arm 70 of the L-shaped member is a central connection point 72, where the L-shaped member 60 is hingedly coupled to the hinge mount shaft 46 via a hinge pin 74. The central connection point 72 and the hinge pin 74 are located at the junction of the longitudinal axes 26 and 28. However, it will be appreciated that alternatively the central connection point 72 and the hinge pin 74 may be located other than at the juncture of the axes 26 and 28, if desired. The long arm 70 attaches the L-shaped member 60 to a nose shell 78. As illustrated, the long arm 70 is along the nose longitudinal axis 26. However, it will be appreciated that other couplings may alternatively be used between connection points of the nose and an outer body or nose shell of the nose.

The tilt actuator 20 operates as follows to control the angle $\alpha$ of deflection between the longitudinal axes 26 and 28. Operation of the motor 30 causes rotation of the lead screw 32, which in turn causes translation of the lead nut 38 along the lead screw. Translation of the lead nut 38 causes corresponding movement of the end 56 of the nut-nose link 54, via their coupling at the hinged nut connection 58. This in turn initiates movement of one end of the short arm 62 of the L-shaped member 60, the link 54 and the short arm being coupled at the offset connection point 68 of the short arm 62 via the hinged nose connection 66. The hinge mount shaft 46 is unmoved by the above actions, the lead nut 38 slidably moving along the surface of the central bore 44 of the hinge mount shaft. Since the hinge mount shaft 46 is unmoved by actuation of the tilt actuator 20, the hinge pin 74 likewise does not move, and the central connection point 72 therefore acts as a pivot point for rotation of the nose 14 relative to the body 12. Movement of the offset connection point 68 thereby changes the angle a between the longitudinal axes 26 and 28, effecting tilting or deflecting of the nose 14 relative to the body 12.

A stop 80 is provided on the lead screw 32 opposite the motor 30. The stop 80 limits travel of the lead nut 38, and may be fixedly attached to the lead screw or may alternatively be otherwise suitably coupled to the lead screw.

It will be appreciated that many variants of the above-described design may alternatively be employed. For example, as noted above, the central connection point 72 may be other than at the junction of the longitudinal axes 26 and 28, if desired. The central connection point 72 and the offset connection point 68 may be parts of separate structures attached to the nose shell 78, rather than being holes in a single member such as the L-shaped member 60. A variety of suitable rotary actuation devices may be employed in place of the motor 30, and the motor 30 may have any of a wide variety of suitable, well-known designs and/or configurations. The linkage between the motor 30 and the connection points 68 and 72 of the nose 14 may alternatively be other than as shown. It will further be appreciated that the translatable member may be translated by other suitable means, for example by coupling the translatable member to a fluid actuator. It will be appreciated as well that many alternative types of linkages may be provided between the translatable member and the nose for deflecting the nose longitudinal axis 26 relative to the body longitudinal axis 28. For example, the linkages may involve couplings utilizing various suitable combinations of gears, belts, translating members, and/or rotating members.

The rotation actuator 22 includes a rotary actuation device such as a rotary motor 84. The rotary motor 84 controls rotary movement of extensions 86 which are a part of, or are coupled to, the hinge mount shaft 46. The rotary motor 84 is thus able to control rotation of the hinge mount shaft 46. Rotating the hinge mount shaft 46 causes rotation of the hinge pin 74, and thus rotation of the nose 14. Since the hinge mount shaft 46 is centered on the body longitudinal axis 28, the rotation of the nose 14 by movement of the extensions 86 is also rotation about the body longitudinal axis 28.

It will be appreciated that the rotary motor 84 may be operatively coupled to the motor 30 to allow compensation for translation of the lead nut 38 resulting from rotation of the lead nut caused by the rotation actuator 22.

It will further be appreciated that the motor 30 and the rotary motor 84 may be operatively coupled to any of a variety of well-known encoders to facilitate determination of nose position. One such encoder may be placed between the lead screw 32 and the hinge mount shaft 46 to measure differential rotation, thereby providing nose angular position with respect to the missile body axis. Alternatively or in addition, an encoder may be placed between the hinge mount shaft 46 and the missile body 12, providing nose roll angle position with respect to the missile body.

It will be appreciated that many variations to the above-described rotation actuator 22 will occur to one skilled in the art. It will further be appreciated that parts of the actuators 20 and 22 may be made of well-known materials, for example metallic materials such as steel.

As shown in FIGS. 1 and 2, all or portions of the tilt actuator 20 and/or the rotation actuator 22 may be within a nose cavity 88 in the nose 14, thus providing for better utilization of the interior volume of the missile 10.

It will be appreciated that the rotation actuator 22 may be used to maintain the nose 14 of the missile 10 in a constant direction, compensating for rotation of the missile body 12. Alternatively or in addition, the rotation actuator 22 may be used to change and/or control the orientation of the plane defined by the longitudinal axes 26 and 28.

Figure 3:
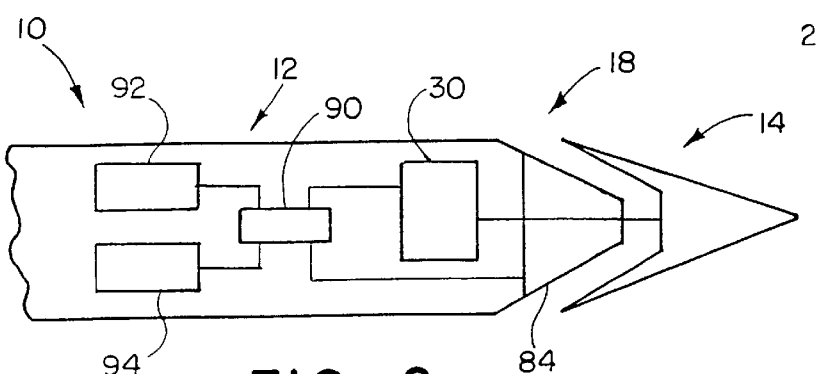
FIG. 3 is a schematic view of the control system of the missile of FIG. 1.

Referring now to FIG. 3, a schematic diagram is shown of one possible control system for the missile 10. A controller 90 is operatively coupled to the motor 30, the rotary motor 84, a target tracking device 92 for tracking a target or desired course of the missile 10, and a roll-rate sensor 94 for sensing roll of the missile body 12.

The motor 30 and the rotary motor 84 are used as described above in the operation of the tilt actuator 20 and the rotation actuator 22, respectively. The target tracking device 92 may be one of a variety of well-known suitable devices for acquiring and/or tracking a target, and/or for analyzing the position, orientation, and/or the speed of the missile 10 to determine its course relative to the location of a target or other destination. The roll-rate sensor 94 is one of a variety of well-known devices for determining the roll rate of the missile 10. The controller 90 is a suitable device for receiving and processing data, and for sending control signals, for example including a microprocessor.

It will be appreciated that alternatively some or all of the controller 90, the target tracking device 92, and the roll-rate sensor 94 may be located outside the body 12. For example, one or more may be located in the missile nose 14. Alternatively, one or more may be located external to the missile, operative coupling of the control system in such a case being made by suitable means, for example, by use of a signal propagating along a wire, or by signals such as radio waves which do not require a solid connection for propagation.

The actuator system 18 of the missile 10 described above may be used to articulate the nose 14 of the missile toward a designated target or along a designated course. This simple nose control or articulation steering mechanism results in appropriate aerodynamic forces to fly the missile toward the target. The actuator system 18 described above provides advantages over prior art systems in that it requires only a small diameter because the tilt actuator 20 and the rotation actuator 22 are coaxial, one being in part nested in part of the other. Moreover, the actuator system 18 described above provides simple means for compensating for rotation of the missile body.

What follows now is an alternate embodiment of the invention. The details of certain common similar features between the alternate embodiment and the embodiment or embodiments described above are omitted in the description of the alternate embodiments for the sake of brevity. It will be appreciated that features of the alternate embodiment may be combined with features of the embodiment or embodiments described above.

Figure 4:
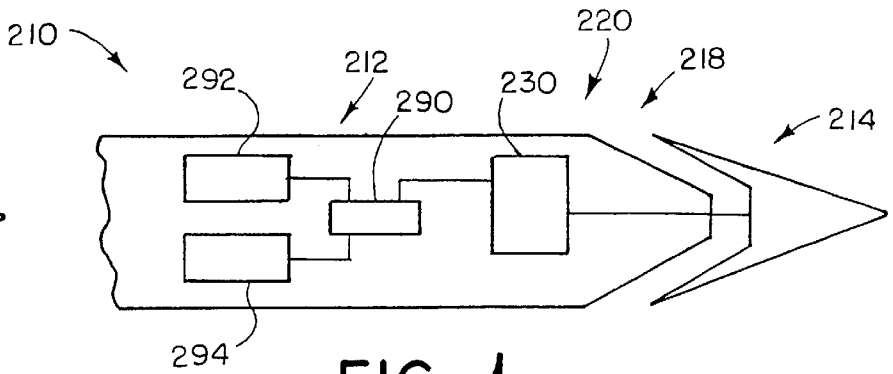
FIG. 4 is a schematic view of an alternate missile which embodies the present invention.

Turning now to FIG. 4, a missile 210 is shown which has a simplified actuator system 218 for articulating a missile nose 214 relative to a missile body 212. The actuator system 218 includes a tilt actuator 220 for tilting the nose 214 relative to the missile body 212. The tilt actuator 220 may be similar to the tilt actuator 20, and may include a motor 230 which is similar to the motor 30 described above, as well as including other components similar to those described above.

The missile 210 may contain a control system to control actuation of the actuator system 218, for example having a controller 290, a target tracking device 292, and a roll-rate sensor 294.

The missile 210, lacking a rotation actuator corresponding to the rotation actuator 22 of the missile 10, is only able to articulate the nose 214 relative to the missile body 212 in a single, fixed plane. However, for a missile that is undergoing roll, either a steady roll or variable-speed roll, articulation of the nose in a single plane may provide adequate steering control. The controller 290 may be configured to move the nose 214 relative to the body 212 at a rate corresponding to the roll rate of the missile 210, thereby maintaining the nose approximately pointed in the direction of a target for the missile. It will be appreciated that the controller 290 may be configured to move the nose 214 in synchronization with a predetermined roll rate, or that alternatively the controller 290 may move the nose 214 in response to signals from the roll-rate sensor 294.

Many well-known means exist for imparting a spin or roll rate to a missile, for example by use of canted fins, spiral grooves in a launch tube, and/or turning vanes in a nozzle of a rocket motor.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a missile nose; and a missile body, the body including a tilt actuator and a rotation actuator each mechanically coupled to the nose;

wherein at least part of the tilt actuator is coaxial with at least part of the rotation actuator.

2. The missile of claim 1, wherein the at least part of the tilt actuator and the at least part of the rotation actuator are coaxial along a longitudinal body axis.

3. The missile of claim 2, wherein the at least part of the rotation actuator includes a hinge mount shaft hingedly connected to the nose.

4. The missile of claim 3, wherein the at least part of the tilt actuator is at least partially within a bore in the hinge mount shaft.

5. The missile of claim 1, wherein the tilt actuator includes a translatable member mechanically linked to an offset connection point on the nose, wherein the offset connection point is offset from a longitudinal body axis.

6. The missile of claim 5, wherein the translatable member and the offset connection point are linked by a link hingedly connected to the translatable member and the offset connection point.

7. The missile of claim 5, wherein the translatable member is a lead nut threadedly coupled to a lead screw, rotation of the lead screw thereby causing translation of the lead nut.

8. The missile of claim 7, wherein the lead screw is operatively coupled to a motor, thereby enabling rotation of the screw.

9. The missile of claim 7, wherein the lead screw is operatively configured to rotate about the longitudinal body axis.

10. The missile of claim 1, wherein the rotation actuator includes a hinge mount shaft and a hinge pin which hingedly connects the hinge mount shaft and a central connection point of the nose which is along a longitudinal body axis.

11. The missile of claim 10, wherein the nose has a longitudinal nose axis, and wherein the central connection point is along the longitudinal nose axis.

12. The missile of claim 10, wherein the tilt actuator includes a translatable member mechanically linked to an offset connection point on the nose, wherein the offset connection point is offset from a longitudinal body axis, translation of the translatable member thereby causing tilting of the nose about the central connection point.

13. The missile of claim 12, wherein the translatable member is a lead nut threadedly coupled to a lead screw, rotation of the lead screw thereby causing translation of the lead nut.

14. The missile of claim 13, wherein the hinge mount shaft has a central bore into which the lead screw protrudes.

15. The missile of claim 1, wherein the rotation actuator includes a rotary actuation device operatively coupled to a hinge mount shaft for rotating the hinge mount shaft and the nose about the longitudinal body axis.

16. The missile of claim 15, wherein the rotary actuation device includes a rotary solenoid.

17. The missile of claim 1, wherein the tilt actuator and the rotation actuator are at least partially in a nose cavity of the nose.

18. A missile comprising:

a missile nose; and a missile body, the body including a pair of actuators, wherein the pair of actuators include a tilt actuator and a rotation actuator each mechanically coupled to the nose;

wherein at least part of one of the actuators is nested within at least part of the other actuator.

19. A missile comprising:

a missile nose; and a missile body which includes a tilt actuator with a translatable member mechanically linked to an offset connection point on the nose;

wherein the translatable member surrounds a longitudinal body axis of the missile body; and wherein the offset connection point is offset from the longitudinal body axis.

20. A missile comprising:

a missile nose; and a missile body which includes a tilt actuator with a translatable member mechanically linked to an offset connection point on the nose;

wherein the offset connection point is offset from a longitudinal body axis; and wherein the translatable member and the offset connection point are linked by a link hingedly connected to the translatable member and the offset connection point.

21. The missile of claim 19, further comprising means for rolling the body about the longitudinal body axis.

22. The missile of claim 21, wherein the tilt actuator rotates the nose in a fixed plane relative to the body.

23. The missile of claim 22, further comprising a controller operatively coupled to the tilt actuator, wherein the controller and the tilt actuator are operatively configured to tilt the nose in synchronization with the rolling of the body.

24. The missile of claim 20, further comprising means for rolling the body about the longitudinal body axis.

25. The missile of claim 24, wherein the tilt actuator rotates the nose in a fixed plane relative to the body.

26. The missile of claim 25, further comprising a controller operatively coupled to the tilt actuator, wherein the controller and the tilt actuator are operatively configured to tilt the nose in synchronization with the rolling of the body.

27. The missile of claim 20, wherein the translatable member surrounds a longitudinal nose of the missile nose.

28. A missile comprising:

a missile nose; and a missile body which includes a tilt actuator with a translatable member mechanically linked to an offset connection point on the nose;

wherein the offset connection point is offset from a longitudinal body axis; and wherein the translatable member is a lead nut threadedly coupled to a lead screw, rotation of the lead screw thereby causing translation of the lead nut.

29. The missile of claim 28, wherein the lead screw is operatively coupled to a motor, thereby enabling rotation of the screw.

30. The missile of claim 28, wherein the lead screw is operatively configured to rotate about the longitudinal body axis.

31. The missile of claim 28, wherein the translatable member surrounds a longitudinal nose of the missile nose.

* * * * *